US008404345B2

(12) United States Patent
Naylor Rocha Gomes et al.

(10) Patent No.: US 8,404,345 B2
(45) Date of Patent: Mar. 26, 2013

(54) MICROCAPSULES WITH FUNCTIONAL REACTIVE GROUPS FOR BINDING TO FIBRES AND PROCESS OF APPLICATION AND FIXATION

(75) Inventors: Jamie Isidoro Naylor Rocha Gomes, Braga (PT); Raquel Maria Magalhaes Vaz Vieira, Guimaraes (PT); Sandra Maria Pinto Cerqueira Barros, Braga (PT)

(73) Assignee: Devan-Micropolis SA, Moreira Da Maja (PT)

( * ) Notice: Subject to any disclaimer, the term of this patent is extended or adjusted under 35 U.S.C. 154(b) by 1147 days.

(21) Appl. No.: 11/912,118

(22) PCT Filed: Feb. 27, 2006

(86) PCT No.: PCT/IB2006/050605

§ 371 (c)(1),
(2), (4) Date: Oct. 19, 2007

(87) PCT Pub. No.: WO2006/117702

PCT Pub. Date: Nov. 9, 2006

(65) Prior Publication Data

US 2008/0193761 A1 Aug. 14, 2008

(30) Foreign Application Priority Data

Apr. 22, 2005 (PT) ..... 103265

(51) Int. Cl.
*B32B 5/16* (2006.01)

(52) U.S. Cl. ..... 428/402.21; 427/180

(58) Field of Classification Search ..... 428/402–402.24; 427/213.3–213.36; 264/4–4.7
See application file for complete search history.

(56) References Cited

U.S. PATENT DOCUMENTS

| | | | | |
|---|---|---|---|---|
| 4,412,959 | A | 11/1983 | Wegner et al. | |
| 4,413,843 | A * | 11/1983 | Iwasaki et al. | 503/215 |
| 6,997,960 | B1 * | 2/2006 | Sano et al. | 8/115.6 |
| 2002/0055560 | A1 | 5/2002 | Nanbu et al. | |
| 2004/0076826 | A1 * | 4/2004 | Lee | 428/402.24 |

FOREIGN PATENT DOCUMENTS

| | | | |
|---|---|---|---|
| EP | 0646673 | A2 | 4/1995 |
| JP | 57027127 | A | 2/1982 |
| JP | 61-028515 | A | 2/1986 |
| JP | 07-109681 | A | 4/1995 |
| JP | 2001-279582 | A | 10/2001 |
| JP | 2003-128932 | A | 5/2003 |
| JP | 2005-023470 | A | 1/2005 |
| WO | 0106054 | A1 | 1/2001 |
| WO | 0162376 | A1 | 8/2001 |
| WO | 02/12607 | A2 | 2/2002 |
| WO | 2006013165 | A1 | 2/2006 |

OTHER PUBLICATIONS

Notification of Reasons for Refusal issued in corresponding Japanese Patent Application No. 2008-507204 on Aug. 2, 2011.
Office Action issued in corresponding Japanese Patent Application No. 2008-507204 on Dec. 4, 2012.

* cited by examiner

*Primary Examiner* — Randy Gulakowski
*Assistant Examiner* — Jeffrey Washville
(74) *Attorney, Agent, or Firm* — Sughrue Mion, PLLC

(57) ABSTRACT

Microcapsules for smart textile materials, containing an active product and with reactive groups, with the objective of chemically binding the microcapsules to the fibers. The microcapsules contain active products such as PCM (phase change materials), or can be of controlled release of products such as fragrances, essential oils, antibacterial and others with the objective to add specific functional properties to the textile materials. They can be applied by padding and spraying followed by thermofixation. In case of products such as knitwear the application process can also be by exhaustion process, given that the microcapsules acquire affinity towards the fibers and react with the fibers during the process. The chemical bond of the controlled release microcapsules with the fibers confers them a higher resistance to washing than the existing microcapsules glued to the fabric by printing or padding.

17 Claims, No Drawings

MICROCAPSULES WITH FUNCTIONAL REACTIVE GROUPS FOR BINDING TO FIBRES AND PROCESS OF APPLICATION AND FIXATION

CROSS REFERENCE TO RELATED APPLICATIONS

This application is a National Stage of International Application No. PCT/IB2006/050605 filed on Feb. 27, 2006, claiming priority based on Portugal Patent Application No. 103265, filed Apr. 22, 2005, the contents of all of which are incorporated herein by reference in their entirety.

FIELD OF THE INVENTION

The present invention relates to microcapsules for smart textile materials and the application processes for such microcapsules.

BACKGROUND OF THE INVENTION

The microcapsules are applied to fibres in textile articles known as smart textiles, to impart a controlled release of different products such as fragrances, antibacterial, insecticides, antioxidants, vitamins or durable materials to impart functions, such as thermal insulation and thermal comfort as in the case of microcapsules of PCM (phase change materials). They are also used as special effects materials, as it is the case of photochromic or thermochromic pigments that change colour according to luminosity or temperature, respectively. The binding of microcapsules to the fibres is usually done with thermoplastic binders or with glue (sizing operation). The production of microcapsules of the controlled release type with polymers, is, for example, described in patent GB1371179 of 1974. PCM microcapsules have normally walls made of polymers obtained by the condensation polymerization of urea-formaldehyde and melamine-formaldehyde, given that these materials are very resistant to temperature and to chemical agents and solvents. Other condensation polymers are used, like polyamide and polyurethane, but they are not appropriate for PCM given that they are not sufficiently resistant. They are only appropriate for the release of the active product since they rupture easily. Other microcapsules also for temporary use on products to be used next to the skin are made of biocompatible products such as chitosan, a product obtained from crab or other crustaceous species.

The application of controlled release microcapsules with binders or with glue during sizing textile processing started in the 1970's. The problem with this form of binding microcapsules is that they come off easily during the washing of the textile article or other processes that involve friction forces, given that they do not have a durable bond with the fibre. This way, the desired effect of the microcapsules is quickly lost by wearing the textile article.

It is therefore convenient that the bonds between fibres and microcapsules be resistant to multiple domestic washing, according to the most recent washing standards. The microcapsules for the controlled release of fragrances, antibacterial agents, insect repellents and other active products, are normally applied in such a way so as to be exposed to friction and so rupturing and releasing the products, such as printing with thermoplastic polymers. They can also be applied by glued padding with binders in pad-mangle machines. Normally they are not applied by exhaustion processes given that they have no affinity towards the fibres. Even if they are applied by exhaustion process, the fabric or knitwear still needs to be padded with binders and the microcapsules subsequently fixed by the thermoplastic binder at high temperatures, in appropriate machines, normally a stenter.

PCM (phase change materials) microcapsules on the other hand should not rupture and are normally applied immersed in a coating or foam constituted of thermoplastic polymers. First, the microcapsules are dispersed in a binder and are then bound to the fibres by a thermal process after coating the material with a ruler or rollers. On non-woven it can be done by spraying or by padding followed by thermal fixation in a roller-machine (foulard), always mixed with binders, being one of the corresponding patents from 1994 (U.S. Pat. No. 5,366,801). The thermal process of thermoplastic fusion of the binder containing the microcapsules with the fibres, is usually realized in a continuous drying and curing machine of the type of a stenter used in textile finishing, or under pressure in a heated calendar rollers, at a temperature higher than the melting point of the thermoplastic binder. Given that the quantity of PCM microcapsules is much higher than in the case of the other microcapsules, normally between 30 and 100% of the weight of the fibre, the quantity of binder is also higher. In this case, the durability of the microcapsules is not an issue, since they are totally involved by a film or coating of binder. Phase Change Materials (PCM) are materials that change phase from solid to liquid and from liquid to solid, with the characteristic that and in doing so they absorb great quantities of energy by changing from solid to liquid and releasing great quantities of energy by changing from liquid to solid. Their energy retention characteristics can also be used as a self-regulation of temperature within pre-defined limits, such as, for example, to convey comfort to the wearer of winter clothing and winter footwear. Given that the direct application of PCM microcapsules on yarns, woven fabrics and knitwear present problems, namely technical ones the more usual applications resort to supports, such as polyurethane foam containing PCM microcapsules, or woven or non-woven materials coated with thermoplastic binders containing PCM microcapsules as referred in U.S. Pat. No. 5,851,338. These supports are then incorporated in clothing or footwear articles. They can also be incorporated in composite materials, such as the ones mentioned in U.S. Pat. No. 6,004,662. PCM microcapsules are usually made of polymers, such as urea-formaldehyde or melamine-formaldehyde.

DESCRIPTION

In the invention we are proposing, the microcapsules do not need binder to fix on the fibres, since they contain reactive groups that are going to react with the fibres. The set of direct bonds between individual microcapsules and the fibres present several advantages in relation to the use of binders containing microcapsules, given that the coatings with binders have many disadvantages, causing namely a loss of flexibility of the textile materials, a higher impermeability to perspiration, causing this way discomfort, and in materials that are in contact with the skin, they cause a harsh handle.

The main objective of the invention we claim, is to avoid the disadvantages caused by the use of binders, trough the direct bond of the microcapsules on the fibres, through chemical bond that also conveys a durability to wear and washing. The chemical bonds are obtained through the introduction of functional groups in the microcapsules that bind chemically to functional groups of the fibres. The chemical bonds can be ionic or, better still, covalent, where a simple chemical reaction takes place by addition or substitution, promoted solely by the pH of the solution, normally alkaline, or resorting to initiators in case of an addition radical reaction, since these bonds are more resistant and since they guarantee the permanence of microcapsules on the fibres even when subjected to physical processes involving friction forces, or chemical processes such as domestic and industrial washing, in washing machines, or dry-cleaning.

In this invention that we propose, microcapsules can be applied without binder, by padding process followed by the passing of the fabric or knitwear through the squeezing rollers. In the case of materials that cannot be padded such as lofty non-woven, the microcapsules are applied by spray. In both processes, padding or spraying, it is still necessary that the chemical reaction takes place at room temperature or at a hot temperature. In the case of reaction at room temperature, the reaction needs a lot more time to occur, being the process similar to the Pad-batch process used for reactive dyes. In case of a process with heating, it is usually applied in a dryer or stenter, a process also used reactive dyes denominated 'Pad-fix' or 'Pad-cure'. Another problem of existing microcapsules is that there is no affinity between the microcapsules and the fibres, mainly because there are no attraction forces, such as ionic or polar Van der Waal's forces such as those existing between dyes and fibres, nor is there formation of a strong chemical bond of the covalent type between the microcapsules and the fibres, which means that the microcapsules have to be applied together with thermoplastic binder by printing, or by padding processes with binder and passage through squeeze rollers and finally thermally fixed. In this invention we also propose the use of microcapsules with functional groups that impart affinity towards the fibres, and that can be applied by exhaustion processes and the groups react with the fibres during the exhaustion process, without being necessary to fix them later with binder in a padding and curing machine. Exhaustion processes are applied in machines in which the material moves in the liquor (bath) without resorting to squeeze rollers, the material being transported by mechanical action and also supported by the movements of the liquor itself. In this liquor it is normally introduced the dye and the auxiliary products necessary for the preparation and dyeing of the material. In this case, before, during or after the dyeing, the microcapsules are introduced into the liquor and, due to their affinity, they adhere to the textile material throughout the process. Examples of these machines are the 'jet' and progressive flow machines used in the dyeing of woven and knitted fabrics and domestic and industrial washing machines. These machines are appropriate for woven and knitted fabrics and, in the domestic and industrial washing machines, microcapsules can be applied to garments and other finished textile articles. For yarns there are special machines that make the liquor circulate through the yarn, which is in the form of bobbin or skein.

The ionic forces that are formed by attraction of opposite charges, cause the microcapsules to have affinity towards the fibres and may therefore be applied by exhaustion processes.

In case of fibres with cationic charges, for example polyamide fibres when in acid conditions, negative charges are introduced into the microcapsules which will impart affinity and a strong bond between microcapsules and fibres. Other groups, such as epoxy groups, convey affinity towards the fibres through polar forces.

In the case of cellulosic fibres, the process is similar to the dyeing process with reactive dyes. Just as with dyes, microcapsules should have groups that convey affinity towards the fibres and can react with the hydroxyl groups of the cellulose.

Microcapsules with functional groups have the additional advantage of being able to be dyed at the same time as the fibres, in the same colour, and in this way the original white colour of the microcapsules will not be seen, which in the case of PCM microcapsules is relevant since they are used in large quantities so as to produce the desired effect, and so they would be noticed otherwise. Dyes should be dyes with affinity towards the microcapsules and/or dyes with a group capable of reacting with the functional group of the microcapsules.

The microcapsules for controlled release of fragrances, antibacterial agents, insect repellent and other active products, are usually applied so that they are exposed to friction to subsequently rupture and to release the products, for example by printing with thermoplastic binders. They can also be applied in fine textiles by padding with a binder, in machines with squeezing rollers. Normally they are not applied by exhaustion process, since they do not have affinity for the fibres. Even if they are applied by exhaustion process, the woven or knitted fabric needs to be padded with a binder and the microcapsules later thermally bound by the thermoplastic binder at high temperatures, in an appropriate machine, usually a stenter. In the invention we are proposing, the set of direct bonds between individual microcapsules and the fibres has several advantages relatively to the use of binding materials containing microcapsules since the use of binders has many disadvantages other than the lack of durability of the microcapsules to friction and washes, causing namely a lack of flexibility of the textile materials, a higher impermeabilization to transpiration, causing therefore discomfort, and in materials in contact with the skin they cause a harsh handle. In this process that we are claiming, microcapsules are chemically bound to the fibres without resorting to binders. The durability of the microcapsules is higher than that of the process of application by binding microcapsules with binders. In this invention that we are claiming, instead of the usage of binders that fix onto fibres, microcapsules containing functional reactive groups are used, binding the microcapsules directly to the fibres. The functional groups are introduced into the microcapsules of urea-formaldehyde, melamine-formaldehyde, polyamide or chitosan, reacting with the amino ($NH_2$) or hydroxyl (OH) groups present in these microcapsules. As an alternative, microcapsules, for example, with a second shell on top of the urea or melamine-formaldehyde shell can be used, made of polymers containing functional groups, poly (glycidyl methacrylate) or any other polymer that may contain epoxy (glycidyl) groups, polyacrylic acid containing carboxylic groups, or other polymers that can react with epoxy groups that form the bond with the fibre, when added jointly with the microcapsules in the application process to the fibre, such as poly(methacrylic acid) or derivatives, that contain carboxylic groups (—COOH), for example, being the binding group a polyglycidyl, containing two or more epoxy groups. This group is particularly useful, once it can react with an epoxy group of a 'bridging' product containing two or more epoxy groups, leaving the other epoxy group free to react with the fibre.

For microcapsules with two polymers, being the outer layer functional, it is, for example, possible to use microcapsules of melamine-formaldehyde coated with a vinyl polymer, where the monomer used for forming the polymer contains a functional group that will form ionic bonds with the fibres, or groups that react with the fibres, such as the epoxy group, alkyls with a halogen substitution, like for example ethyl chlorine, vinyl groups, heterocycles, for example.

In case of intending to use only the microcapsule with the layer of urea-formaldehyde, melamine-formaldehyde, polyamide or chitosan, the introduction of functional groups, such as epoxy groups or ethyl chlorine, for example, will be done through a reaction between the amine groups that do not react with the formaldehyde, or hydroxyl groups, and therefore remaining free, with bifunctional compounds that contain epoxy groups, alkyl groups substituted with a halogenous, vinyl groups, heterocyclics, remaining the other group free for reacting with the fibre.

It is convenient that the bonds between the fibres and the microcapsules are resistant to multiple domestic washing, according to the requirements of the most recent washing standards. This is the main objective of the invention we are claiming. In the cellulosic fibres this resistance is conferred, for example, by the irreversible covalent bond that is formed between the epoxy group present in the shell of the microcapsule and the cellulosate groups of ionised cellulose (cel-$O^-$). This reaction should be carried out in alkaline conditions so that ionization of the cellulose occurs with the formation of the cellulosate groups. Another group that can be introduced in the microcapsules that reacts with the cellulose fibres can be the —CO—CH═CHR group, where R can be a hydrogen or a halogen. The reaction can be a nucleophilic addition reaction with the cellulosate ion in alkaline conditions or a radical addition reaction with the hydroxyl group of the cellulosic fibre, in the presence of an initiator. Another group can be the —CO—$(CH_2)_n$Cl group, that reacts by nucleophilic substitution with the cellulosate ion of cellulose in alkaline conditions.

In case of polyamide and wool fabrics, it is the amine groups that react with the epoxy groups, —CO—CH═CHR, dichlorotriazine or the —CO—$(CH_2)_n$Cl group of the microcapsules. In these cases the reaction occurs in slightly acid, neutral or basic conditions.

In the case of acrylic fibres, the sole shell or the outer shell, has as functional group the quaternary ammonium salt group, —$N^+(R)_3$, where R is an alkyl group, that will link through an ionic bond to the anionic groups present in the fibres.

Instead of the microcapsules reacting directly with the fibres, a 'bridging' group can be used between the microcapsules and the fibre can be used, being the microcapsules and bridging groups applied simultaneously. These are bifunctional compounds with two of the reactive groups already mentioned, epoxy, —CO—CH═CHR, dichlorotriazine or —CO—$(CH_2)_n$Cl, one reacting with the microcapsule and the other with the fibre, forming that way a binding bridge between the microcapsules and the fibre. Another group can be ethylene imine, similar to epoxy once it is also a highly unstable and reactive ring, reacting in a similar way by an attack from the cellulosate ion of the cellulose, opening the ring during the reaction.

Next, examples are given of the previous preparation of microcapsules with reactive groups by reaction with one of the bifunctional groups, as well as of the simultaneous application of the bifunctional product and the microcapsules during the application process of the microcapsules on the fibre.

EXAMPLE 1

Preparation of PCM Microcapsules with an Outside Shell of poly(glycidyl methacrylate)

100 g of PCM microcapsules were added to 1000 ml of water. The microcapsules were dispersed by agitation. Next, glycidyl methacrilate monomer and potassium persulfate were added. Temperature was raised up to 90° C. and was kept for two hours at this temperature. Afterwards, the microcapsules were filtered, washed and dried in an oven at 60° C.

EXAMPLE 2

A mixture of 50 g/L of PCM microcapsules with an outer shell of poly(glycidyl methacrylate), 2.75 g/L of sodium hydroxide were applied by exhaustion, in a machine with liquor circulation and fabric movement, to a sample of 5 Kg of bleached jersey cotton knitwear, with a liquor ratio of 1:10 and a temperature of 75° C. for 30 minutes. The samples was then rinsed and dried at 120° C.

EXAMPLE 3

Preparation of PCM Microcapsules with an Outside Shell of poly(glycidyl methacrylate)

100 g of PCM microcapsules were added to 1000 ml of water. The microcapsules were dispersed by agitation. Next, acid methacrylic monomer and potassium persulphate were added. Temperature was raised up to 90° C. and was kept for two hours at this temperature. Afterwards, the microcapsules were filtered, washed and dried in an oven at 60° C.

EXAMPLE 4

A mixture of 50 g/L of PCM microcapsules with an outer shell of poly(acid acrylic acid), 25 g/L epichlorydrin, 2.75 g/L of sodium hydroxide were applied by exhaustion, in a machine with liquor circulation and fabric movement, to a sample of 5 Kg of bleached jersey cotton knitwear, with a liquor ratio of 1:10 and a temperature of 75° C. for 30 minutes. The samples was then rinsed and dried at 120° C.

EXAMPLE 5

A mixture of 50 g/L of PCM microcapsules with an outer shell of poly(glycidyl methacrylate), 25 g/L of epichlorydrin, 2.75 g/L of sodium hydroxide were applied by exhaustion, in a machine with liquor circulation and fabric movement, to a sample of 5 Kg of bleached jersey cotton knitwear, with a liquor ratio of 1:10 and at a temperature of 75° C. for 30 minutes. The samples was then rinsed and dried at 120° C.

EXAMPLE 6

A mixture of 50 g/L of PCM microcapsules of poly(methacrylic acid), 25 g/L of ethylene glycol di-glycidyl ether were applied by exhaustion, in a machine with liquor circulation and fabric movement, to a sample of 5 Kg of polyamide jersey knitwear, with a liquor ratio of 1:10 and a temperature of 75° C. for 30 minutes. The samples was then rinsed and dried at 120° C.

The invention claimed is:

1. A process for directly chemically binding microcapsules having a sole or outer shell of urea-formaldehyde, melamine-formaldehyde, polyamide or chitosan to fibres, comprising reacting free amino (—NH) or hydroxyl (—OH) groups of the shell with a first functional group of a bifunctional compound and reacting a second functional group of the same bifunctional compound with the fibres, whereby the microcapsule is directly bonded to the fibre, through the bifunctional compound, by covalent chemical binding, wherein the bifunctional compound comprises first and second reactive functional groups, the first reactive function group is selected from the group consisting of epoxy group, halogen-substituted alkyl group, and vinyl group and wherein the second reactive functional group is a functional group selected for reaction with the fibres.

2. The process for directly chemically binding microcapsules according to claim 1, wherein the first and second reactive functional groups of the bifunctional compound comprise at least one of the following:

two or more epoxy groups, an epoxy group of epichlorydrin or derivatives, a —CO—$(CH_2)_n$Cl group, di-chloro or tri-chlorotriazine group, a —CO—CH=CHR group, where R is a hydrogen or a halogen.

3. The process for directly chemically binding microcapsules according to claim 1, wherein the bifunctional compound is epichlorohydrin, and the free amino (—NH) or hydroxyl (—OH) groups present in the shell react with the —CO—(CH)Cl group of the epichlorydrin, leaving the remaining epoxy group free to react with the fibre.

4. The process for directly chemically binding microcapsules according to claim 1, wherein the bifunctional compound comprises two or more epoxy groups, and the free amino (—NH) or hydroxyl (—OH) groups present in the shell react with one of the epoxy group of the bifunctional compound, leaving a remaining epoxy group free to react with the fibre.

5. The process for directly chemically binding microcapsules according to claim 1, wherein the bifunctional compound is epichlorohydrin, and the free amino (—NH) or hydroxyl (—OH) groups react with the epoxy group of the epichlorohydrin leaving the remaining —CO—$(CH_2)_n$Cl group free to react with the fibre.

6. The process for directly chemically binding microcapsules according to claim 1, wherein the free amino (—NH) or hydroxyl (—OH) groups react with a di-chloro or tri-chlorotriazine group of a bifunctional compound, in which one of the chlorine atoms is substituted in the reaction by the amino (—NH) or hydroxyl (—OH) group of the shell and the other chorine atom is substituted in the reaction by the fibre.

7. The process for directly chemically binding microcapsules according to claim 1, wherein the microcapsules are applied to the textile fibres by an exhaustion process.

8. The process for directly chemically binding microcapsules according to claim 1, wherein the microcapsules are applied to the textile fibres by a padding process.

9. The process for directly chemically binding microcapsules according to claim 1, wherein the microcapsules are applied to the textile fibres by a spray process.

10. The process for directly chemically binding microcapsules according to claim 1, wherein the textile fibre used is a cellulosic fibre, a polyamide fibre, a wool fibre, an acrylic fibre or a modacrylic fibre.

11. Microcapsules binding to textile fibres obtainable by the process according to any one of claims 1-10.

12. The microcapsules according claim 11 characterised by containing in the interior an active product.

13. The microcapsules according to claim 12, wherein the active product is a phase change material (PCM) for temperature regulation selected from the group consisting of n-octacosane, n-heptacosane, n-hexacosane, n-pentacosane, n-tetracosane, n-tricosane, n-docosane, n-heneicosane, n-eicosane, n-nonadecane, n-octadecane, n-heptadecane, n-hexadecane, n-pentadecane, n-tetradecane, n-tridecane, and n-dodecane.

14. The microcapsules according to claim 12, wherein the active product is a ther-mochromic or photochromic material.

15. The microcapsules according to claim 12, wherein the active product is an aroma, an essential oil, a fragrance, an antimicrobial, an insect repellent, an insecticide, a disinfectant, a hydrant, an anti-cellulite, aloe-vera, an antioxidant or a vitamin for controlled release by rupture of the wall caused by friction, or another process of solubilization or degradation of the shell, of the type that is applied on fibres so that they produce a controlled release of the microencapsulated product.

16. Textile materials having microcapsules covalently bound thereto by the process of any one of claims 1-10.

17. The process for directly chemically binding microcapsules according to claim 1, wherein the second reactive functional group is selected from the group consisting of epoxy group, halogen-substituted alkyl group and vinyl group.

* * * * *